US012668987B2

(12) United States Patent
Fox

(10) Patent No.: US 12,668,987 B2
(45) Date of Patent: Jun. 30, 2026

(54) BRACKET FOR A WOODEN POST

(71) Applicant: Fox Hardwood Lumber Company, L.L.C., Franklin, TN (US)

(72) Inventor: Samuel Fox, Franklin, TN (US)

(73) Assignee: Fox Hardwood Lumber Company, L.L.C., Franklin, TN (US)

( * ) Notice: Subject to any disclaimer, the term of this patent is extended or adjusted under 35 U.S.C. 154(b) by 131 days.

(21) Appl. No.: 18/775,701

(22) Filed: Jul. 17, 2024

(65) Prior Publication Data

US 2026/0022581 A1 Jan. 22, 2026

(51) Int. Cl.

| | |
|---|---|
| ***E04H 12/22*** | (2006.01) |
| ***E02D 27/42*** | (2006.01) |
| ***E04B 1/26*** | (2006.01) |

(52) U.S. Cl.

CPC ..... *E04H 12/2269* (2013.01); *E02D 27/42* (2013.01); *E04B 1/2608* (2013.01); *E04H 12/2253* (2013.01); *E04B 2001/2644* (2013.01)

(58) Field of Classification Search

CPC ..... E04H 12/2269; E04H 12/2253; E04H 12/2261; E02D 27/42; E04B 1/2608; E04B 2001/2644

USPC ..... 52/707, 708, 709, 715, 298

See application file for complete search history.

(56) References Cited

U.S. PATENT DOCUMENTS

| | | | | | |
|---|---|---|---|---|---|
| 284,219 | A * | 9/1883 | Mehew | E04H 12/2215 | 52/165 |
| 772,928 | A * | 10/1904 | Dunlap | E04H 12/2269 | 52/298 |
| 1,791,135 | A | 2/1931 | Kummer | | |
| 4,199,908 | A * | 4/1980 | Teeters | E04H 12/2284 | 52/295 |
| 4,924,648 | A | 5/1990 | Gilb | | |
| 5,375,384 | A * | 12/1994 | Wolfson | E04B 1/0007 | 52/297 |
| D703,029 | S * | 4/2014 | Fox | D8/373 | |
| 8,864,096 | B1 * | 10/2014 | Fox | E04H 12/2269 | 248/539 |
| 9,366,052 | B1 * | 6/2016 | Warner | E04H 12/2253 | |
| 9,428,902 | B1 * | 8/2016 | LoFranco | E04B 1/2608 | |
| 10,060,151 | B2 | 8/2018 | Fox | | |
| 10,100,508 | B1 * | 10/2018 | Fox | E04B 1/2604 | |
| 10,358,811 | B1 * | 7/2019 | Fox | E04B 1/2604 | |
| 11,555,325 | B1 | 1/2023 | Fox | | |
| 2004/0026679 | A1 | 2/2004 | Terrels | | |
| 2007/0267552 | A1 | 11/2007 | Meyer | | |
| 2019/0284828 | A1 * | 9/2019 | Benton | E04H 12/2269 | |
| 2026/0002376 | A1 * | 1/2026 | Shamroukh | E04H 12/2269 | |

* cited by examiner

*Primary Examiner* — Brent W Herring
(74) *Attorney, Agent, or Firm* — Shane Cortesi

(57) ABSTRACT

A bracket that connects a support post to a support surface is described. In some embodiments, the bracket includes a base plate, a left side plate, a right side plate, a front plate, a rear plate and a horizontal plate. The bracket may include a hollow cavity located below the horizontal plate and a recess for holding an upright post located above the horizontal plate. The bracket may also include fastener holes above the horizontal plate to secure an upright post located in the recess to the bracket.

26 Claims, 11 Drawing Sheets

BRACKET FOR A WOODEN POST

BACKGROUND OF THE INVENTION

The present invention relates generally to supports for posts, and more particularly to an anchoring device for supporting a post.

Various devices are known in the art that connect a support post to a surface support structure, such as floor, base, pillar, column, footer, slab, or other general support structure. Some of these prior art anchoring devices, or brackets, have attempted to facilitate the attachment between the support post and the support structure for the construction of a building, such as a dwelling, home, office, barn, and the like. Most of these prior art devices have failed to adequately allow for the installation of those brackets when the support structure comprises a hard material and the post held by those brackets is of a different material. This is especially true for posts that extend upward in a vertical direction.

U.S. Pat. No. 9,938,745, owned by Applicant, describes a bracket for supporting a post from a support surface. The bracket comprises a base, at least one stanchion extending from the base, and a plate attached to the stanchion opposite the base. The '745 is primarily directed to an anchor device that is bolted to a support surface.

There is a continuing need for brackets, particularly those are designed to be embedded in concrete or another support surface.

BRIEF SUMMARY OF THE INVENTION

The present disclosure provides a bracket as described herein.

DETAILED DESCRIPTION OF THE INVENTION

Figure 1:
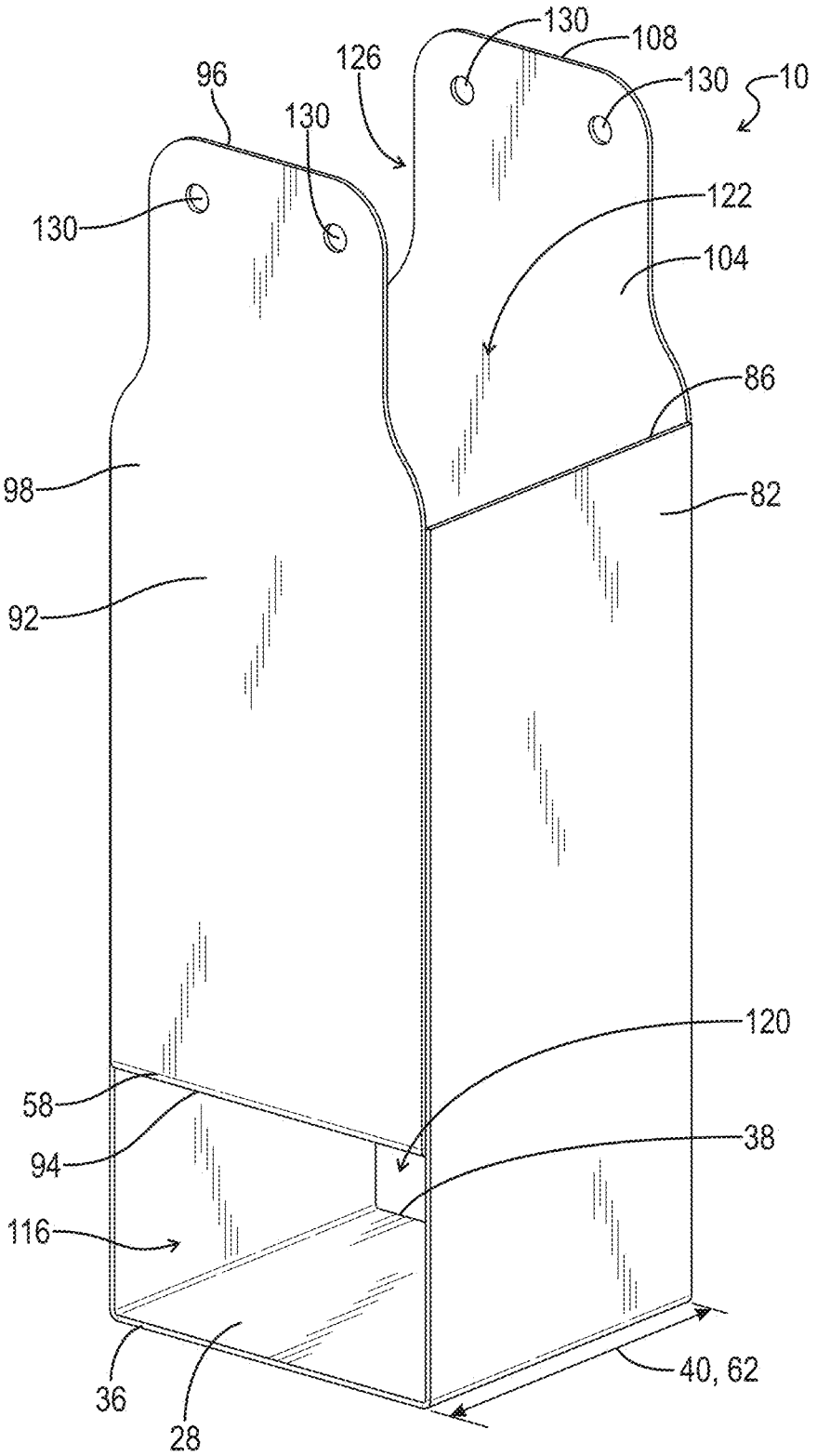
FIG. 1 illustrates a perspective view of a bracket of one embodiment of the present disclosure.
Figure 2:
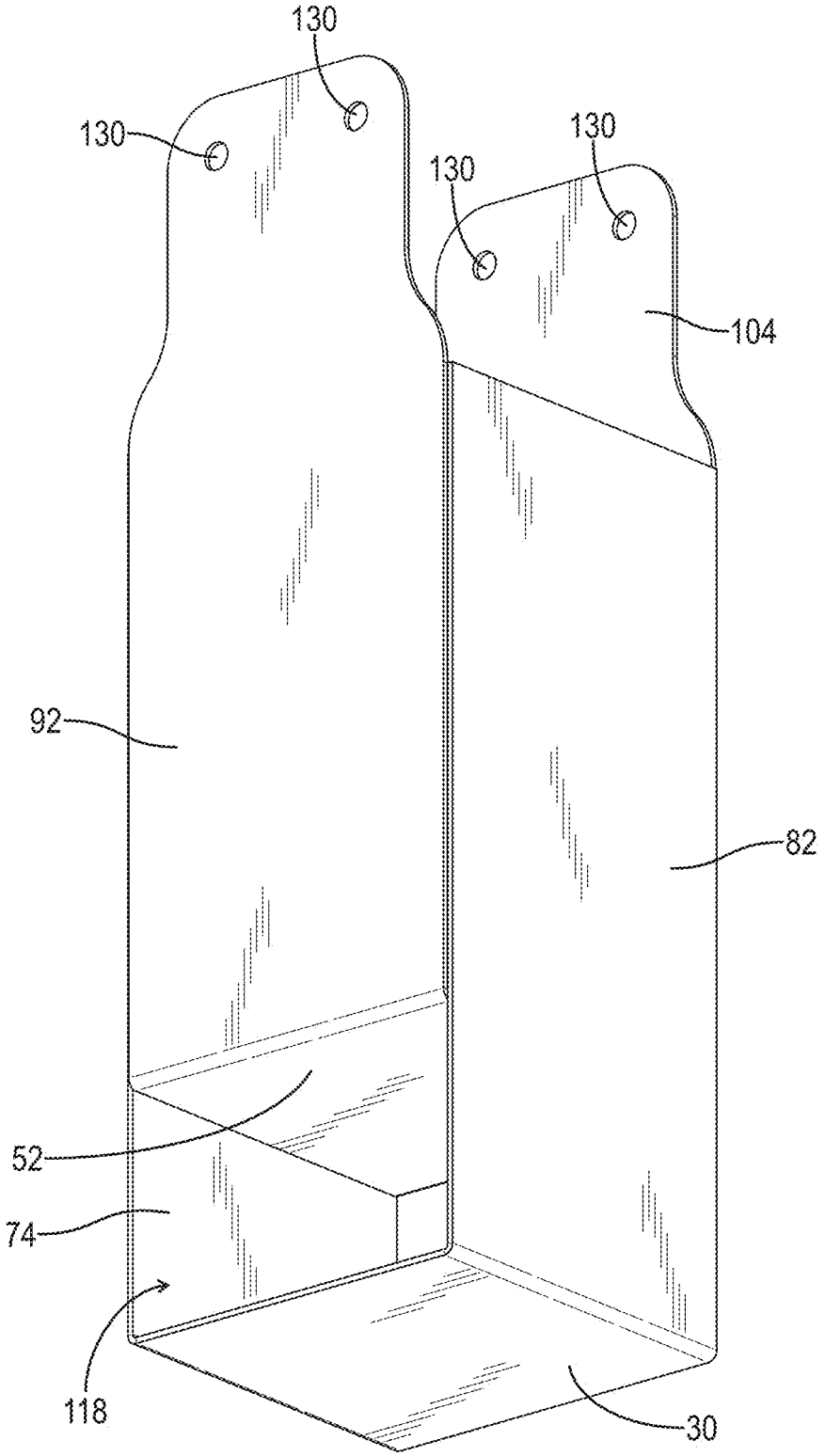
FIG. 2 illustrates a bottom perspective view of the bracket of FIG. 1.
Figure 3:
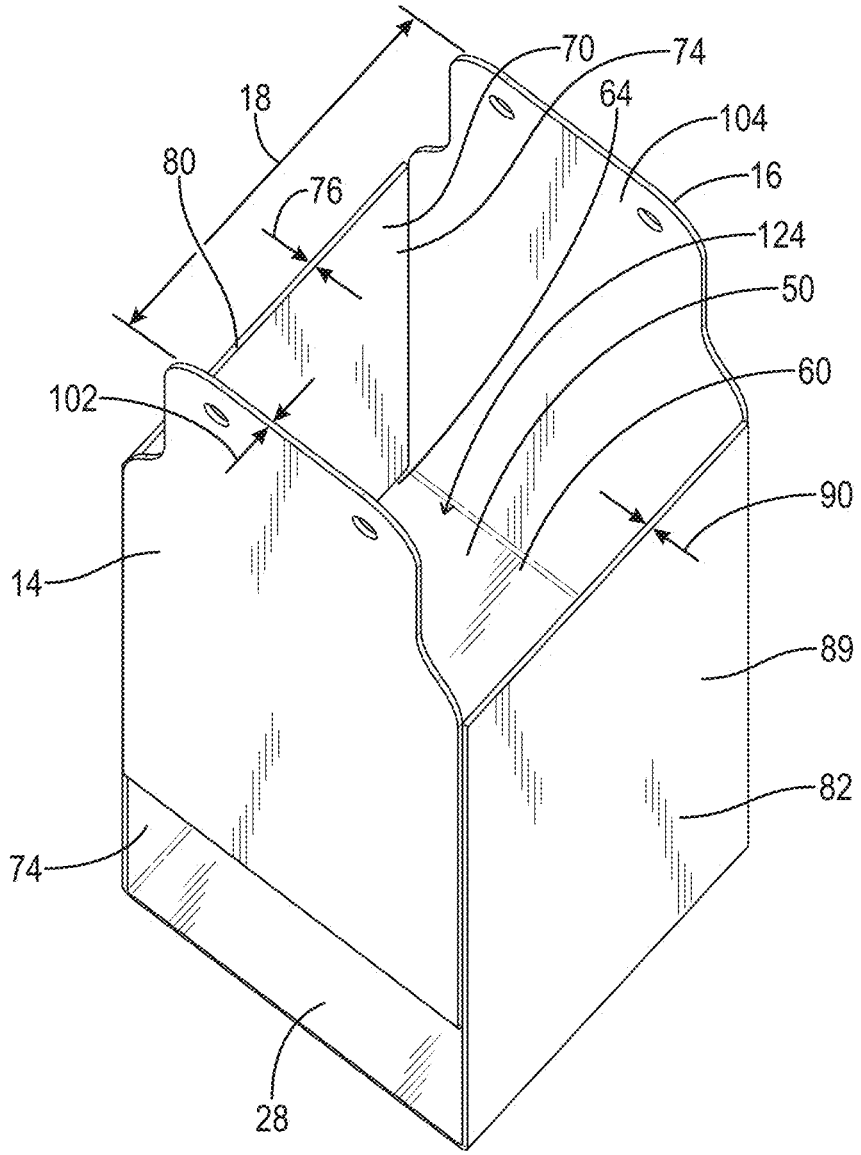
FIG. 3 illustrates a top perspective view of the bracket of FIG. 1.
Figure 4:
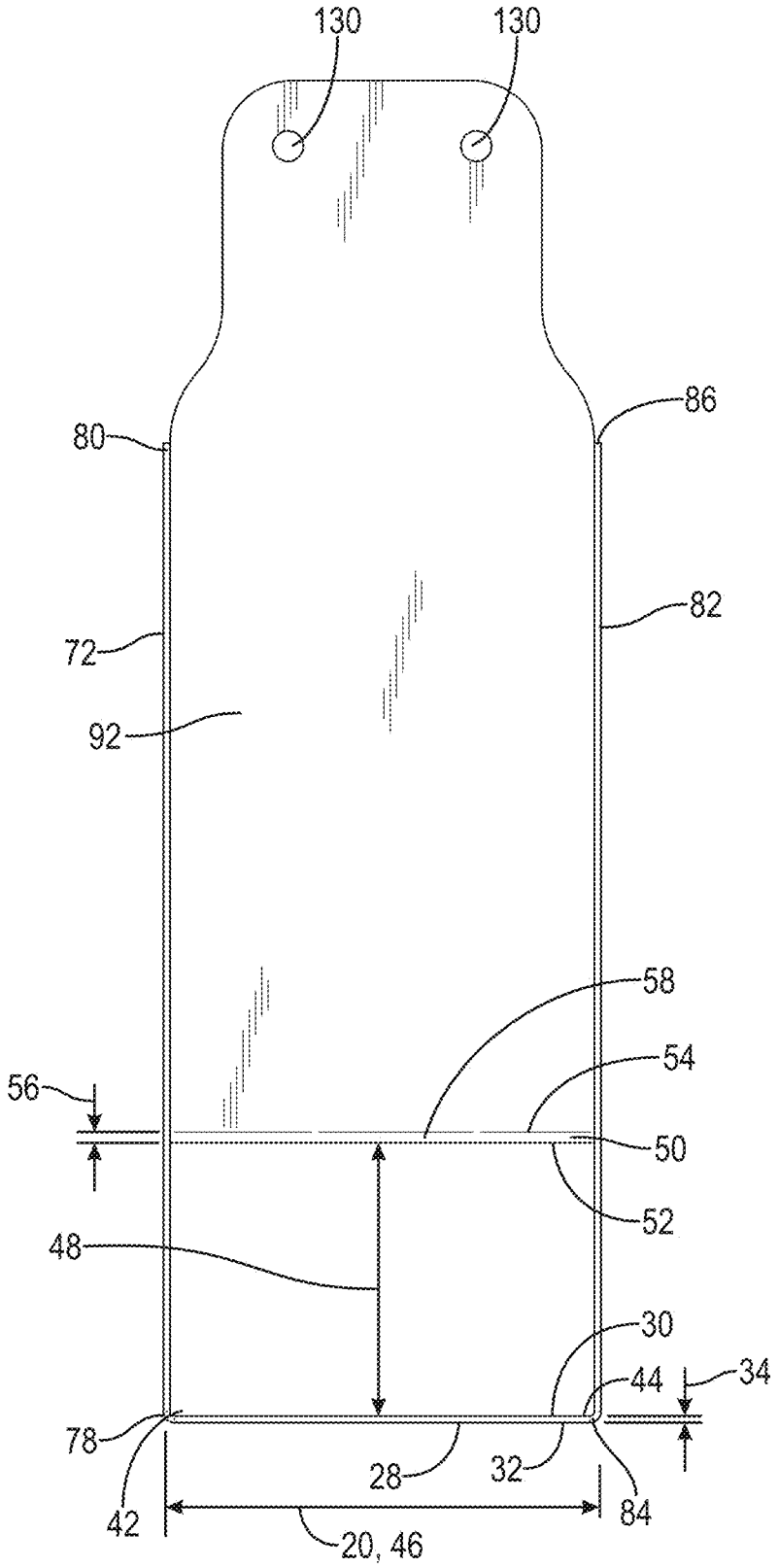
FIG. 4 illustrates a front elevation view of the bracket of FIG. 1.
Figure 5:
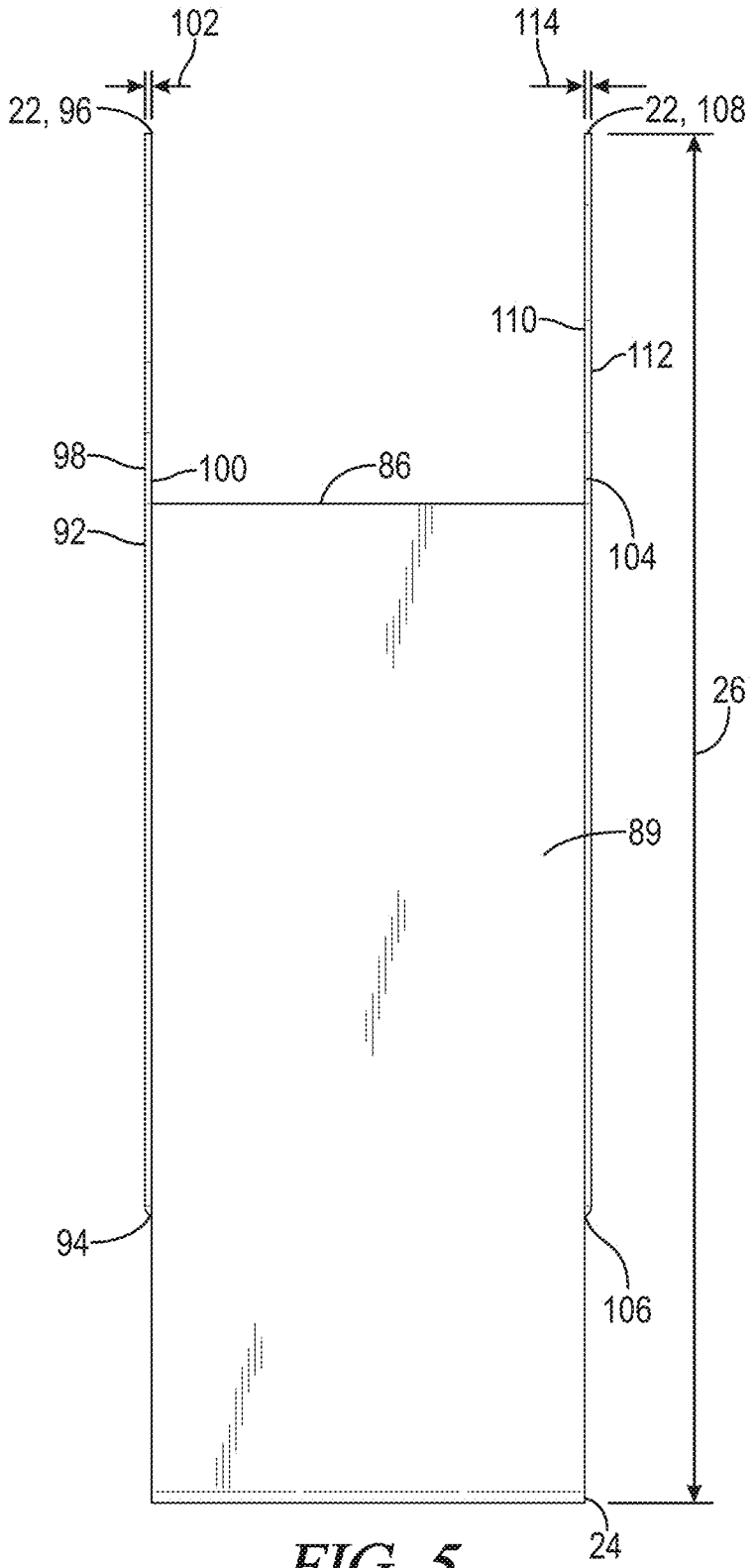
FIG. 5 illustrates a side elevation view of the bracket of FIG. 1.
Figure 6:
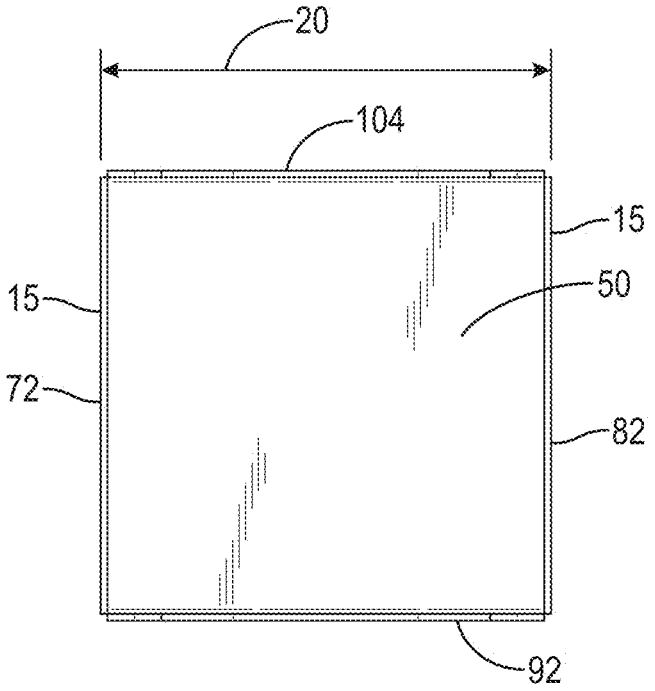
FIG. 6 illustrates a top plan view of the bracket of FIG. 1.
Figure 7:
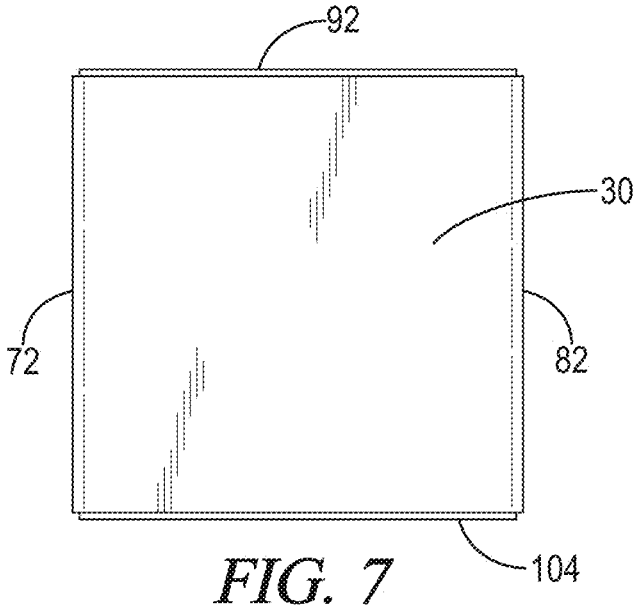
FIG. 7 illustrates a bottom plan view of the bracket of FIG. 1.
Figure 8:
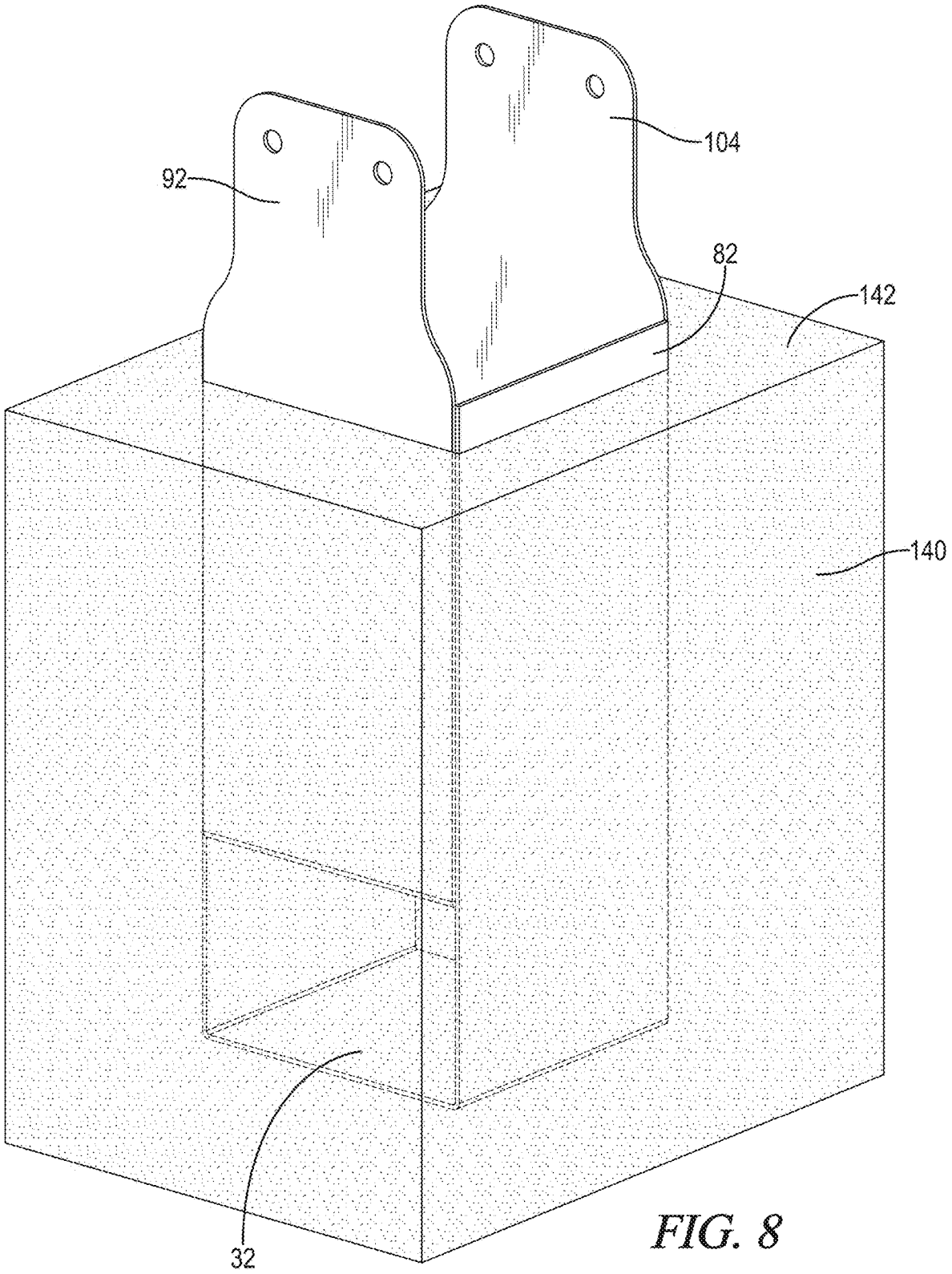
FIG. 8 illustrates a perspective view of the bracket of FIG. 1 embedded in concrete.

With reference to FIGS. 1-12, the present disclosure provides a bracket 10 and use of the same. In the drawings, not all reference numbers are included in each of the drawings for the sake of clarity. FIGS. 1-12 are CAD drawings drawn to scale, however, it will be appreciated that other dimensions are possible.

Referring further to FIGS. 1-12, in some embodiments, the present disclosure provides a bracket 10 configured to support a support post 12 in an upright position. The bracket 10 may comprise a bracket front 14, a bracket rear 16, a bracket length 18 extending from the front 14 to the bracket rear 16, a bracket left side 15, a bracket right side 19, a bracket width 20 extending from the bracket left side 15 to the bracket right side 19 and perpendicular to the bracket length 18, a bracket top 22, a bracket bottom 24, and a bracket height 26 extending from the bracket top 22 to the bracket bottom 24 and perpendicular to the bracket length 18 and bracket width 20. The bracket 10 may further comprise a base plate 28 comprising base plate bottom 30 (which is optionally flat), a base plate top 32 (which is optionally flat), a base plate height 34 extending from the base plate top 32 to the base plate bottom 30 and parallel to the bracket height 26, a base plate front 36, a base plate rear 38, a base plate length 40 extending from the base plate front 36 to the base plate rear 38 and parallel to the bracket length 18, a base plate left side 42, a base plate right side 44 and a base plate width 46 extending from the base plate left side 42 to the base plate right side 44 and parallel to the bracket width 20.

The bracket may further comprise a horizontal plate 50 comprising a horizontal plate bottom 52 (which is optionally flat) located above the base plate top 32 and separated from the base plate top 32 by a gap 48, the horizontal plate 50 further comprising a horizontal plate bottom 52, a horizontal plate top 54 (which is optionally flat), a horizontal plate height 56 extending from the horizontal plate top 54 to the horizontal plate bottom 52 and parallel to the bracket height 26, a horizontal plate front 58, a horizontal plate rear 60, a horizontal plate length 62 extending from the horizontal plate front 58 to the horizontal plate rear 60 and parallel to the bracket height 26, a horizontal plate left side 64, a horizontal plate right side, and a horizontal plate width extending from the horizontal plate left side 64 to the horizontal plate right side and parallel to the bracket width 20.

The bracket 10 may further comprise a left side plate 70 extending upward from the base plate 28, supporting the horizontal plate 50, the left side plate 70 having a left side plate left side 72, a left side plate right side 74 that optionally confronts and supports the horizontal plate left side 64, a right side plate thickness 90 extending from and the left side plate left side 72 to the left side plate right side 74 and parallel to the bracket width 20, a left side plate bottom 78 that may be adjacent to the base plate 28, a left side plate top 80 located above the horizontal plate top 54.

The bracket 10 may further comprise a right side plate 82 extending upward from the base plate 28, supporting the horizontal plate 50, the right side plate 82 optionally oriented parallel to the left side plate 70 and having a right side plate bottom 84 adjacent to the base plate 28, a right side plate top 86 located above the horizontal plate top 54 and at approximately the same height as the left side plate top 80, a right side plate left side facing the left side plate right side 74 and optionally confronting and supporting the horizontal plate right side, a right side plate left side, a right side plate thickness 90 extending from the right side plate left side to the right side plate right side 89 and parallel to the bracket width 20.

The bracket 10 may further comprise a front plate 92 supporting the horizontal plate 50, oriented perpendicular to the left and right side plates 70/82, and having a front plate bottom 94 adjacent to the horizontal plate 50 and a front plate top 96 located above the horizontal plate top 54 (and optionally above the left side plate and right side plate tops 80/86), a front plate front 98, a front plate rear 100 optionally confronting the horizontal plate front 58, a front plate thickness 102 extending from the front plate front 98 to the front plate rear 100 and parallel to the bracket length 18.

The bracket 10 may further comprise a rear plate 104 supporting the horizontal plate 50, oriented perpendicular to the left and right side plates 70/82 and parallel to the front plate 92, and having a rear plate bottom 106 adjacent to the horizontal plate 50 and a rear plate top 108 located above the horizontal plate top 54 and optionally at approximately the same height as the front plate top 96 (and optionally above the left side plate and right side plate tops 80/86), a rear plate front 110 optionally confronting the horizontal plate rear 60, a rear plate rear 112, and a rear plate thickness 114 extending from the rear plate front 110 to the rear plate rear 112 and parallel to the bracket length 18.

Optionally, as shown in FIGS. 1-12, the horizontal plate bottom 52, the base plate top 32, the left side plate right side 74 and the right side plate left side define a cavity 116 that may be substantially hollow and may have an open front 118 and an open rear 120.

Optionally, as shown in FIGS. 1-12, the horizontal plate top 54, the left side plate right side 74, the right side plate left side, the front plate rear 100, and the rear plate front 110 form a recess 122 configured to support a support post 12 in an upright position, the recess 122 having a bottom 124 defined by the horizontal plate top 54 and an open top 126.

Optionally, the horizontal plate 50 extends from the left side plate 70 to the right side plate 82 parallel to the bracket width 20 and from the front plate 92 to the rear plate 104 parallel to the bracket length 18.

Optionally, in use, as shown in FIGS. 9-12, the bracket 10 is embedded in a support surface 140 (e.g., concrete) so that the horizontal plate 50 is located below a top of the support surface 140.

Optionally, in use, as shown in FIGS. 9-12, a support post 12 is provided and placed in an upright position in the recess 122 so that a top 144 of the support post 12 is located below the top of the support surface 140 and a bottom 146 of the support post 12 is located at the top of the support surface 140.

Optionally, as shown in FIGS. 1-12, one or more fasteners 128 are used to secure the support post 12 to the bracket 10. More particularly, for example, the front plate 92 and the rear plate 104 each may comprise one or more fastener apertures 130 located above the horizontal plate top 54 and extending through the thickness of the respective plate and/or the left side plate 70 and the right side plate 82 each comprise one or more fastener apertures 130 located above the horizontal plate top 54 extending through the thickness of the respective plate. More particularly, the one or more fastener apertures 130 may comprise one or more vertically aligned and horizontally aligned fastener apertures 130 located above the horizontal plate top 54 and extending through the thickness of the respective plate and/or one or more vertically aligned and horizontally aligned fastener apertures 130 located above the horizontal plate top 54 and extending through the thickness of the respective plate. For example, as shown in FIGS. 1-12, the one or more fastener apertures 130 may comprise a front plate fastener aperture 130 extending from the front plate front 98 to the front plate rear 100 and located below the front plate top 96 and a rear plate fastener aperture 130 extending from the rear plate front 110 to the rear plate rear 112 and located below the rear plate top 108, and more particularly, as shown in FIGS. 1-12, the one or more front plate fastener aperture 130 comprises a left front plate fastener aperture 130 and a right front plate aperture 130 located to the right of, and vertically aligned with, the left front plate aperture 130, wherein the rear plate fastener aperture 130 comprises a left rear plate fastener aperture 130 and a right rear plate aperture 130 located to the right of, and vertically aligned with, the left rear aperture 130, wherein the left front plate fastener aperture 130 is aligned vertically and horizontally with the left rear plate fastener aperture 130, and further wherein the right front plate fastener aperture 130 is aligned vertically and horizontally with the right rear plate fastener aperture 130.

Figure 9:
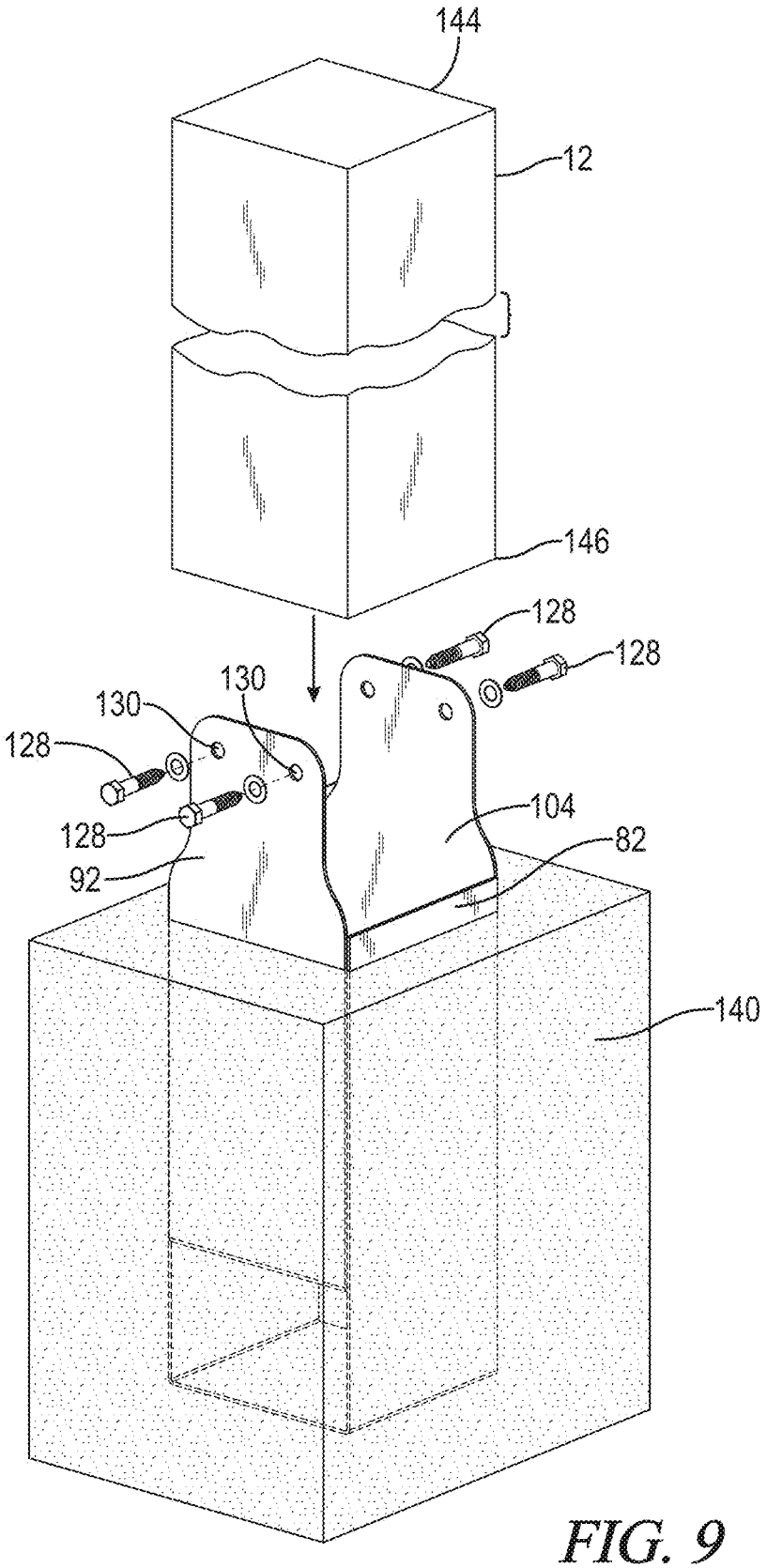
FIG. 9 illustrates a perspective view of the bracket of FIG. 1 showing how a support post may be positioned into the recess and secured to the left and right side plates using a first type of fasteners.
Figure 10:
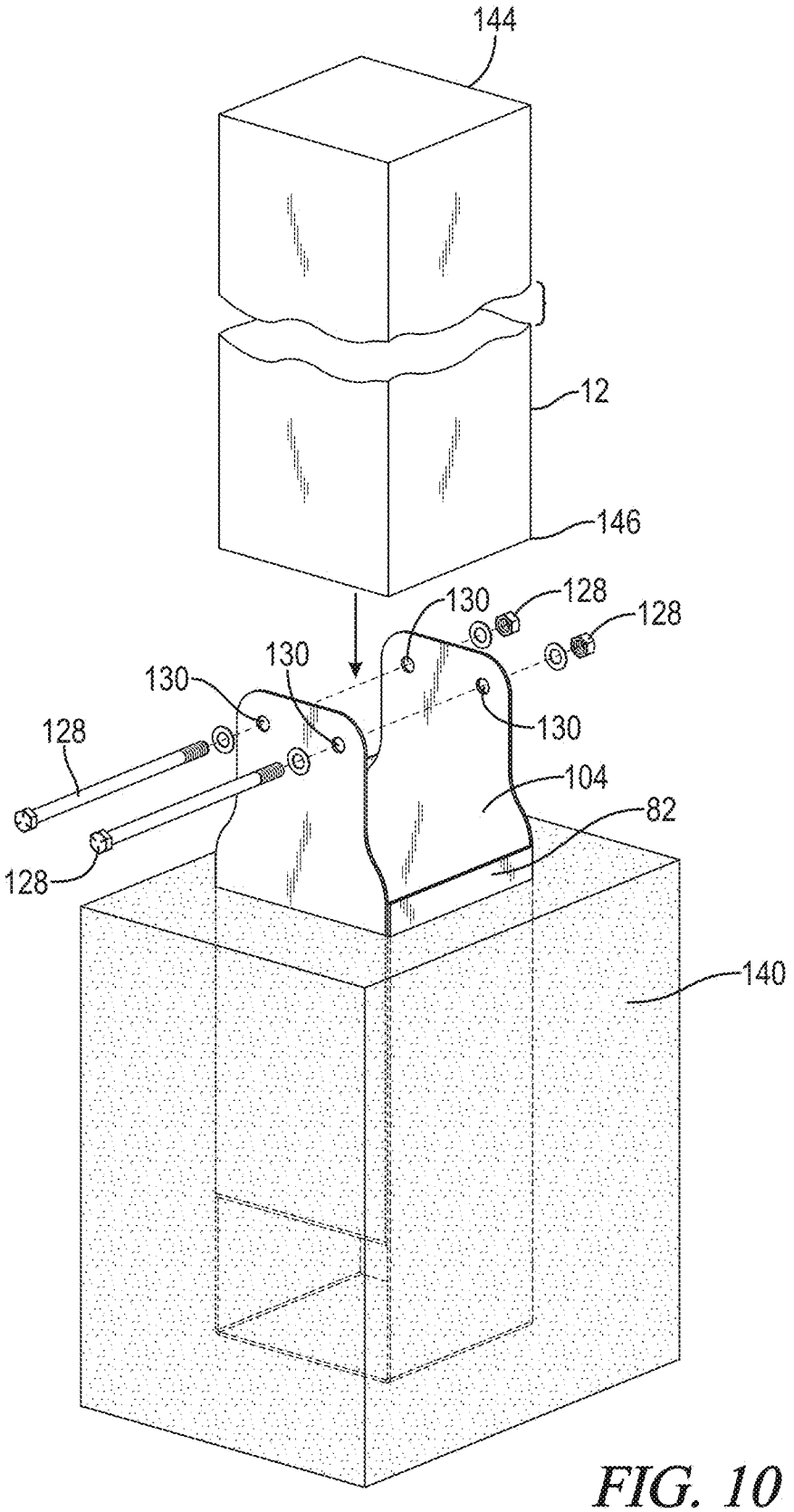
FIG. 10 illustrates a perspective view of the bracket of FIG. 1 showing how a support post may be positioned into the recess and secured to the left and right side plates using a second type of fasteners.
Figure 11:
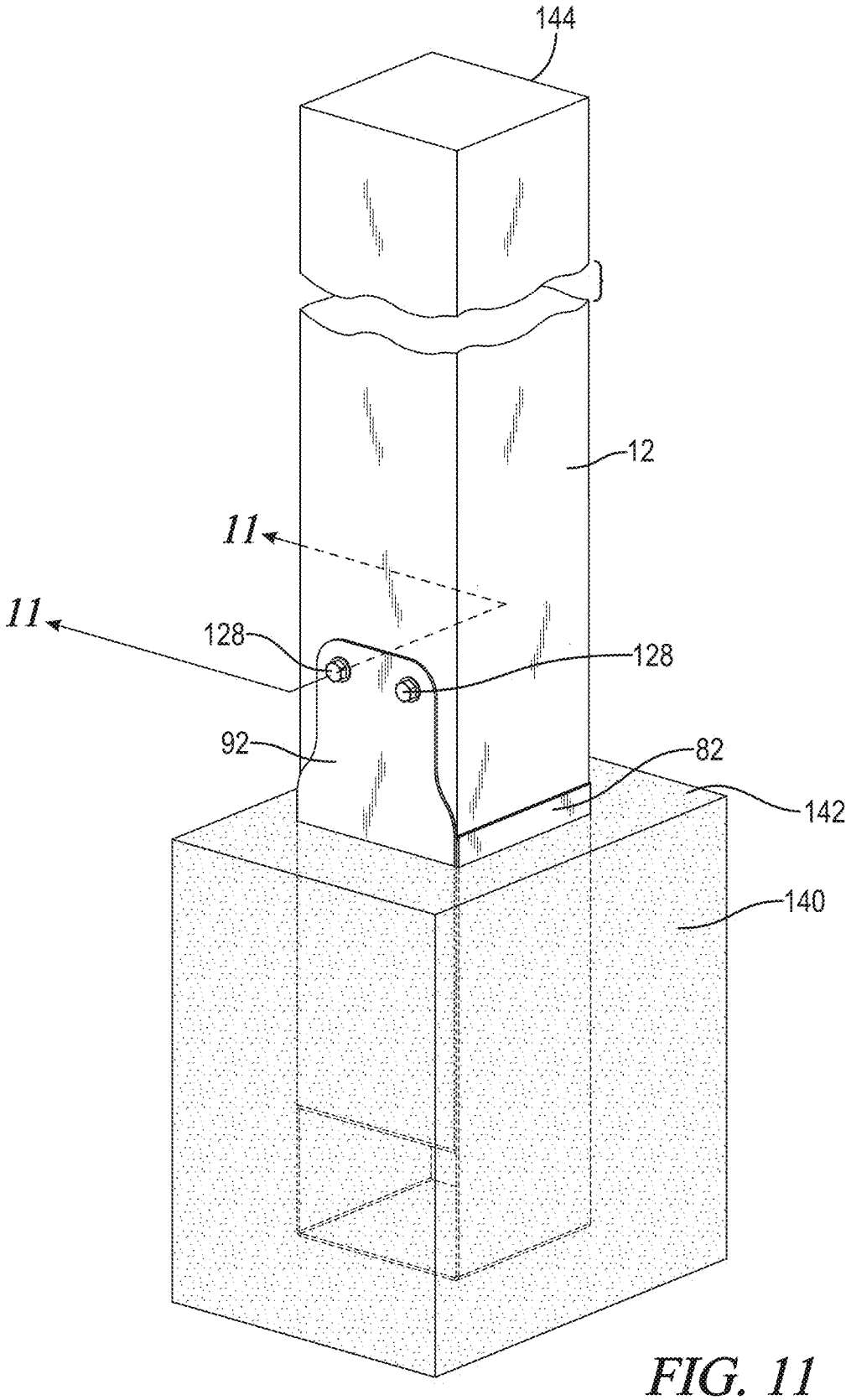
FIG. 11 illustrates a perspective view of the bracket and support post of FIG. 10
Figure 12:
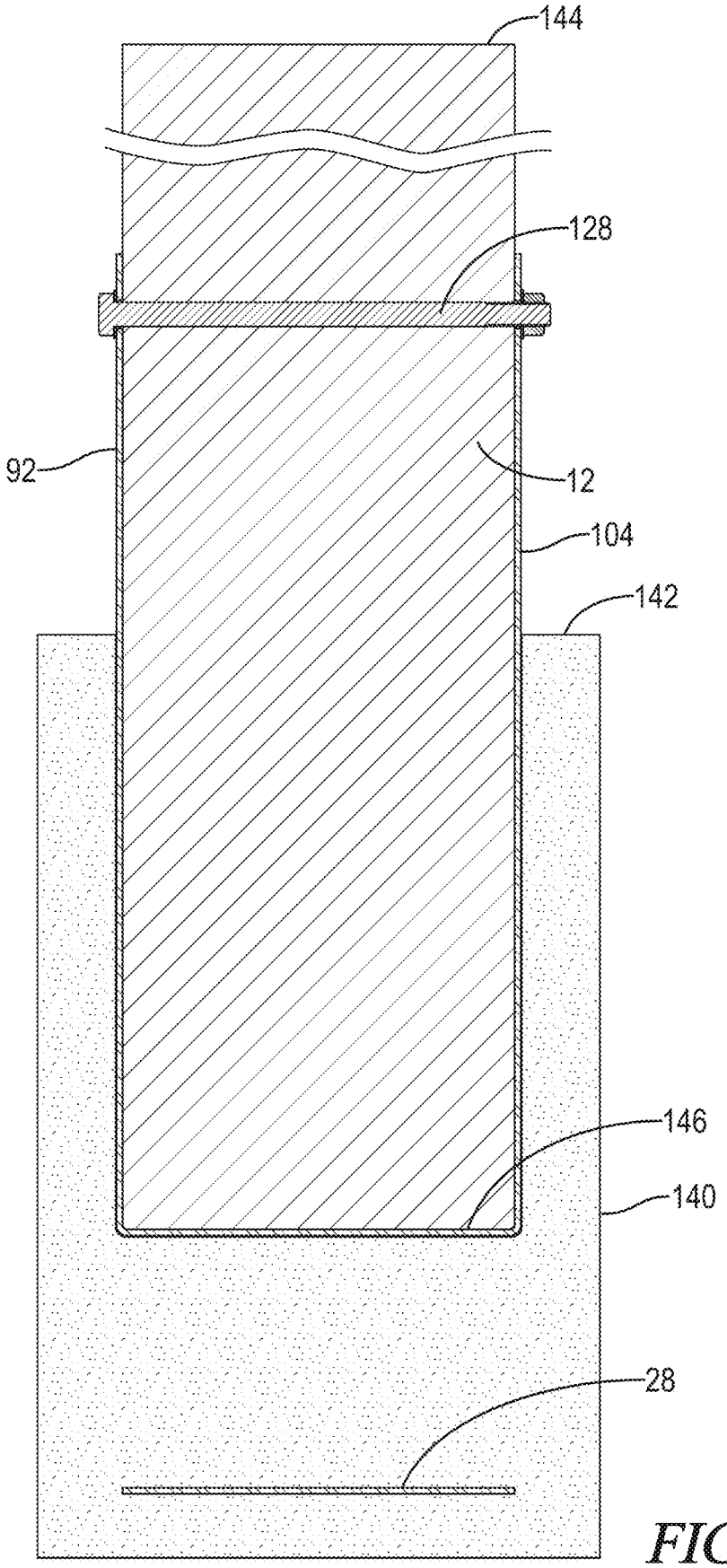
FIG. 12 illustrates a side, sectional view of the bracket and support post of FIG. 11 taken along line 12-12 of FIG. 11.

Optionally, in use, as shown in FIGS. 9-12, one or more fasteners 128 are positioned through the one or more fastener apertures 130 and into the support post 12 to secure the support post 12 to the bracket 10. The fasteners 128 may comprise one or more bolts and nuts as shown in FIGS. 10-12 for example, or alternatively lag screws, as shown in FIG. 9. However, it will be appreciated that any suitable fastener may be used Optionally, as shown in FIGS. 9-12, the support surface 140 is concrete and the embedding comprises placing the bracket 10 in concrete so that the horizontal plate 50 is located below a top of the concrete, and allowing the concrete to set, and optionally the concrete extends through the substantially hollow cavity 116. Optionally, the bracket top 22 is located above the top of the concrete. Optionally, the front plate tops 96 are located above the top of the concrete (so that the recess 122 is substantially free of concrete). Optionally, if the support surface 140 is concrete, the tops of the front, rear, left and right side plates 96/108/70/82 are located are at least about 2 inches above the concrete to prevent water on the concrete from running down into the bracket 10.

Optionally, the bracket 10 comprises one or more of the features shown in FIGS. 1-12. For example, optionally, the cavity 116 is rectangular. Optionally, the horizontal plate 50 is rectangular. Optionally, the left and right side plates 70/82 are rectangular. Optionally, the left and right side plates 70/82 are the same height. Optionally, the front plate rear 100, the rear plate front 110 and the horizontal plate top 54 are flat. Optionally, at least the portion of the left side plate left side 72 and the right side plate left side plate that are above the horizontal plate top 54 are flat. Optionally, the support post 12 is rectangular. Optionally, the horizontal plate front 58 is located directly above the base plate front 36 and wherein the horizontal plate rear 60 is located directly above the base plate rear 38. Optionally, the base plate 28 and the horizontal plate 50 are rectangular and have approximately the same length and width. Optionally, the front plate 92 and rear plate 104 each comprise a width parallel to the bracket width 20, wherein the front plate 92 is wider at the top of the front plate 92 than at the bottom of the front plate 94 and further wherein the width of the rear plate 104 is narrower at the top of the rear plate 108 than at the bottom of the rear plate 106. Optionally, the front plate 92 and rear plate 104 each comprise a width parallel to the bracket width 20, wherein the widths of the front and rear plate are tapered above the horizontal plate 50. Optionally, the horizontal plate left side 64 is located to the left of the left side plate left side 72, wherein the horizontal plate right side is located to the right of the right side plate right side 89, wherein the horizontal plate front 58 is located to the rear of the front plate rear 100, and further wherein the horizontal plate rear 60 is located to the front of the rear plate front 110. Optionally, the left and right side plate bottoms 78/84 do not extend below the base plate bottom 30, and further wherein the base plate bottom 30 is flat and forms the bracket bottom 24. Optionally, the one or more fastener apertures 130 are circular. Optionally, the tops of the front plate 96, rear plate 108, the left side plate 70 and the right side plate 82 are free. Optionally, the support post 12 is comprised of wood.

In some embodiments, the plates may be discrete parts that are welded together. In other embodiments, the bracket 10 may be prepared by injection molding for example in which case the plates may be integrally attached to each other.

PARTS LIST

| | |
|---|---|
| Bracket | 10 |
| Support post | 12 |
| Bracket front | 14 |
| Bracket rear | 16 |
| Bracket left side | 15 |
| Bracket right side | 19 |
| Bracket length | 18 |
| Bracket width | 20 |
| Bracket top | 22 |
| Bracket bottom | 24 |
| Bracket height | 26 |
| Base plate | 28 |
| Base plate bottom | 30 |
| Base plate top | 32 |
| Base plate height | 34 |
| Base plate front | 36 |
| Base plate rear | 38 |
| Base plate length | 40 |
| Base plate left side | 42 |
| Base plate right side | 44 |
| Base plate width | 46 |
| Gap (height) | 48 |
| Horizontal plate | 50 |
| Horizontal plate bottom | 52 |
| Horizontal plate top | 54 |
| Horizontal plate height | 56 |
| Horizontal plate front | 58 |
| Horizontal plate rear | 60 |
| Horizontal plate length | 62 |
| Horizontal plate left side | 64 |
| Horizontal plate right side | Not shown |
| Horizontal plate width | Not shown |
| Left side plate | 70 |
| Left side plate left side | 72 |
| Left side plate right side | 74 |
| Left side plate thickness | 76 |
| Left side plate bottom | 78 |
| Left side plate top | 80 |
| Right side plate | 82 |
| Right side plate bottom | 84 |
| Right side plate top | 86 |
| Right side plate left side | Not shown |
| Right side plate right side | 89 |
| Right side plate thickness | 90 |
| Front plate | 92 |
| Front plate bottom | 94 |
| Front plate top | 96 |
| Front plate front | 98 |
| Front plate rear | 100 |
| Front plate thickness | 102 |
| Rear plate | 104 |
| Rear plate bottom | 106 |
| Rear plate top | 108 |
| Rear plate front | 110 |
| Rear plate rear | 112 |

-continued

| | |
|---|---|
| Rear plate thickness | 114 |
| Cavity | 116 |
| Cavity open front | 118 |
| Cavity open rear | 120 |
| Recess | 122 |
| Recess bottom | 124 |
| Recess open top | 126 |
| Fasteners | 128 |
| Fastener apertures | 130 |
| Support surface | 140 |
| Support surface top | 142 |
| Support post top | 144 |
| Support post bottom | 146 |

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. It is understood that use of the singular embraces the plural and vice versa. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously.

What is claimed is:

1. A method of supporting a support post in an upright position, the method comprising the steps of:

a) providing a bracket having a bracket front, a bracket rear, a bracket length extending from the bracket front to the bracket rear, a bracket left side, a bracket right side, a bracket width extending from the bracket left side to the bracket right side and perpendicular to the bracket length, a bracket top, a bracket bottom, and a bracket height extending from the bracket top to the bracket bottom, perpendicular to the bracket length and bracket width, the bracket configured to support a support post in an upright position, the bracket further comprising:

a base plate comprising a base plate bottom, a base plate top, a base plate height extending from the base plate top to the base plate bottom and parallel to the bracket height, a base plate front, a base plate rear, a base plate length extending from the base plate front to the base plate rear and parallel to the bracket height, a base plate left side, a base plate right side and a base plate width extending from the base plate left side to the base plate right side and parallel to the bracket length, a horizontal plate comprising a horizontal plate bottom located above the base plate top and separated from the base plate top by a gap, the horizontal plate further comprising a horizontal plate top, a horizontal plate height extending from the horizontal plate top to the horizontal plate bottom and parallel to the bracket height, a horizontal plate front, a horizontal plate rear, a horizontal plate length extending from the horizontal plate front to the horizontal plate rear and parallel to the bracket height, a horizontal plate left side, a horizontal plate right side, and a horizontal plate width extending from the horizontal plate left side to the horizontal plate right side and parallel to the bracket width;

a left side plate extending upward from the base plate and supporting the horizontal plate, the left side plate having a left side plate left side, a left side plate right side, a left side plate thickness extending from the left side plate left side to the left side plate right side and parallel to the bracket width, a left side plate bottom adjacent to the base plate, and a left side plate top located above the horizontal plate top;

a right side plate extending upward from the base plate, supporting the horizontal plate, the right side plate oriented parallel to the left side plate, the right side plate comprising a right side plate bottom adjacent to the base plate, a right side plate top located above the horizontal plate top and at approximately the same height as the left side plate top, a right side plate left side facing the left side plate right side, a right side plate left side, a right side plate thickness extending from the right side plate left side to the right side plate right side and parallel to the bracket width;

a front plate supporting the horizontal plate, oriented perpendicular to the left and right side plates, and having a front plate bottom adjacent to the horizontal plate and a front plate top located above the horizontal plate top, a front plate front, a front plate rear, a front plate thickness extending from the front plate front to the front plate rear and parallel to the bracket length; and a rear plate supporting the horizontal plate, oriented perpendicular to the left and right side plates and parallel to the front plate, and having a rear plate bottom adjacent to the horizontal plate and a rear plate top located above the horizontal plate top and at approximately the same height as the front plate top, a rear plate front, a rear plate rear, and a rear plate thickness extending from the rear plate front to the rear plate rear and parallel to the bracket length, wherein the front plate and the rear plate each comprise one or more fastener apertures located above the horizontal plate top and extending through the thickness of the respective plate, and/or the left side plate and the right side plate each comprise one or more fastener apertures located above the horizontal plate top extending through the thickness of the respective plate, wherein the horizontal plate bottom, the base plate top, the left side plate right side and the right side plate left side define a substantially hollow cavity having an open front and an open rear;

wherein the horizontal plate top, the left side plate right side, the right side plate left side, the front plate rear, and the rear plate front form a recess configured to support a support post in an upright position, the recess having a bottom defined by the horizontal plate top and an open top, further wherein the horizontal plate extends from the left side plate to the right side plate parallel to the bracket width and from the front plate to the rear plate parallel to the bracket length;

b) embedding the bracket in a support surface comprising a support surface top so that the horizontal plate is located below the top of the support surface;

c) providing a support post comprising a support post top and a support post bottom;

d) placing the support post in an upright position in the recess; and e) positioning one or more fasteners through the one or more fastener apertures and into the support post to secure the support post to the bracket.

2. The method of claim 1 wherein the one or more fastener apertures comprise one or more vertically aligned and horizontally aligned fastener apertures located above the horizontal plate top and extending through the thickness of the respective plate and/or one or more vertically aligned and horizontally aligned fastener apertures located above the horizontal plate top and extending through the thickness of the respective plate.

3. The method of claim 1 wherein the one or more fastener apertures comprise a front plate fastener aperture extending from the front plate front to the front plate rear and located below the front plate top and a rear plate fastener aperture extending from the rear plate front to the rear plate rear and located below the rear plate top.

4. The method of claim 3 wherein the one or more front plate fastener aperture comprises a left front plate fastener aperture and a right front plate aperture located to the right of, and vertically aligned with, the left front plate aperture, wherein the rear plate fastener aperture comprises a left rear plate fastener aperture and a right rear plate aperture located to the right of, and vertically aligned with, the left rear aperture, wherein the left front plate fastener aperture is aligned vertically and horizontally with the left rear plate fastener aperture, and further wherein the right front plate fastener aperture is aligned vertically and horizontally with the right rear plate fastener aperture.

5. The method of claim 1 wherein the support surface is concrete and step b) comprises placing the bracket in the concrete so that the horizontal plate is located below a top of the concrete and allowing the concrete to set.

6. The method of claim 5 wherein after step b), the concrete extends through the substantially hollow cavity.

7. The method of claim 5 wherein the bracket top is located above the top of the concrete.

8. The method of claim 7 wherein the front plate tops are located above the top of the concrete.

9. The method of claim 1 wherein the horizontal plate is rectangular and further wherein the substantially hollow cavity is rectangular.

10. The method of claim 1 wherein, after steps a)-e), the support post top is located above the support surface top and the support post bottom is located below the support surface top.

11. The method of claim 1 wherein the left and right side plates are rectangular.

12. The method of claim 1 wherein the left and right side plates are the same height.

13. The method of claim 1 wherein the front plate rear, the rear plate front and the horizontal plate top are flat.

14. The method of claim 1 wherein at least the portion of the left side plate left side and the right side plate left side plate that are above the horizontal plate top are flat.

15. The method of claim 1 wherein the support post is rectangular.

16. The method of claim 1 wherein the horizontal plate front is located directly above the base plate front and wherein the horizontal plate rear is located directly above the base plate rear.

17. The method of claim 1 wherein the base plate and the horizontal plate are rectangular and have approximately the same length and width.

18. The method of claim 1 wherein the front plate and rear plate each comprise a width parallel to the bracket width, wherein the width of the front plate is shorter at the top of the front plate than at the bottom of the front plate and further wherein the width of the rear plate is shorter at the top of the rear plate than at the bottom of the rear plate.

19. The method of claim 1 wherein the front plate and rear plate each comprise a width parallel to the bracket width, wherein the widths of the front and rear plate are tapered above the horizontal plate.

20. The method of claim 1 wherein the horizontal plate left side is located to the left of the left side plate left side, wherein the horizontal plate right side is located to the right of the right side plate right side, wherein the horizontal plate front is located to the rear of the front plate rear, and further wherein the horizontal plate rear is located to the front of the rear plate front.

21. The method of claim 1 wherein the horizontal plate is welded to the left side plate, the right side plate, the front plate and the rear plate above the base plate top.

22. The method of claim 1, wherein the left and right side plate bottoms do not extend below the base plate bottom, and further wherein the base plate bottom is flat and forms the bracket bottom.

23. The method of claim 1 wherein the one or more fastener apertures are circular.

24. The method of claim 1 wherein the tops of the front plate, the rear plate, the left side plate and the right side plate are free.

25. The method of claim 1 wherein the support post is comprised of wood.

26. The method of claim 1 wherein the horizontal plate bottom and the left and right side plates are located at least 3 inches above the base plate top.

* * * * *